United States Patent [19]

Nishida

[11] Patent Number: 4,664,054

[45] Date of Patent: May 12, 1987

[54] SMALL-SIZED MARINE CRAFT

[75] Inventor: Hiroshi Nishida, Miki, Japan

[73] Assignee: Kawasaki Jukogyo Kabushiki Kaisha, Kobe, Japan

[21] Appl. No.: 747,301

[22] Filed: Jun. 21, 1985

[30] Foreign Application Priority Data

Jun. 22, 1984 [JP] Japan ..... 59-93261[U]

[51] Int. Cl.[4] ..... B63B 35/00

[52] U.S. Cl. ..... 114/270

[58] Field of Search ..... 114/270, 123, 357; 440/88, 89, 38, 42

[56] References Cited

U.S. PATENT DOCUMENTS

| | | | |
|---|---|---|---|
| 3,369,518 | 2/1968 | Jacobson | 114/270 |
| 3,394,673 | 7/1968 | Hamori | 114/270 |
| 3,397,670 | 8/1968 | Bedford | 114/270 |
| 3,718,111 | 2/1973 | Del Vecchio | 114/270 |
| 3,948,206 | 4/1976 | Tyler | 114/270 |

*Primary Examiner*—Joseph F. Peters, Jr.
*Assistant Examiner*—Jesús D. Sotelo
*Attorney, Agent, or Firm*—Leydig, Voit & Mayer

[57] ABSTRACT

A small-sized marine craft having a shell provided with a deck, an engine mounted in a bow portion of the shell, a propulsion device provided on a stern portion of the shell, and a steering handle bar disposed on a bow portion of the shell. The central section of a rear part of the deck is protruded so as to provide a substantially flat seat portion extending longitudinally of the craft. A fuel tank is disposed in the portion of the shell under the seat portion and extending to the stern portion of the shell. A battery service is included at an intermediate portion of the front portion of the deck so as to be accessible from the outside.

1 Claim, 4 Drawing Figures

SMALL-SIZED MARINE CRAFT

BACKGROUND OF THE INVENTION

1. Field of the Invention

The present invention relates to a small-sized marine craft for use in marine sports or for leisure purposes, which is suited for maneuvering in a sea area near the shore under the control of a rider on the stern portion who sits or stands on the stern portion and grips a steering handle bar positioned from the bow portion. More particularly, the invention is concerned with a novel construction for mounting a fuel tank in a marine craft of the type mentioned above.

2. Description of the Related Art

In general, a small-sized marine craft of the kind described has an engine mounted in an engine room formed in the bow portion of the shell and a propulsion means provided at the stern portion of the same. The rider stands up or sits on a deck portion formed on the shell to the rear of the engine room and grips the steering handle bar on the bow portion of the shell. The shell has a breadth which is substantially equal to or slightly greater than the shoulder breadth of a rider.

The propulsion means may be a propeller or a pumped water jet. Where a pumped water jet is used, the marine craft can be steered by changing the direction of the jet.

This type of marine craft is generally light in weight and has an excellent running performance. For instance, it can run at a considerably high speed of 50 km/h or so. Therefore, it is desirable that the shell as a whole is made compact through an efficient use of the space in the shell while maintaining a good balance in the port and starboard directions, as well as in the fore and aft directions.

In the conventional marine crafts of the type described, the fuel tank is mounted together with an engine and other auxiliary machines in an engine room formed in a bow portion of the shell. This in turn requires a large volume of the engine room and makes it difficult to realize a compact construction for the shell as a whole. In addition, the fuel tank imposes a considerably heavy weight, e.g. about 10 kg when filled up with fuel, so that the bow portion of the marine craft is unfavorably burdened with a considerable weight such as to increase a tendency for the bow to submerge, particularly when the marine craft is running at a low speed. In addition, since the bow portion of the marine craft of this type pitches up and down more vigorously than the stern portion, the fuel in the fuel tank waves severely thus causing various unfavourable effects.

SUMMARY OF THE INVENTION

Accordingly, an object of the invention is to provide a small-sized marine craft in which the shell is made compact without impairing the balance by virtue of a specific construction for mounting the fuel tank.

The small-sized marine craft in accordance with the invention includes a shell having a deck, an engine mounted on a bow portion of the shell, a propulsion means mounted on the stern portion of the shell and a steering handle bar standing up from a bow portion. The central rear portion of the deck is protruded so as to provide the base of a seat for the rider. A fuel tank is mounted in the space under the seat base formed on the central rear portion of the deck.

With this arrangement, it is possible to realize a compact construction for the shell without impairing the balance, because the space under the rear portion of the deck is effectively utilized as a space for accommodating the fuel tank.

DESCRIPTION OF THE PREFERRED EMBODIMENTS

Figure 1:
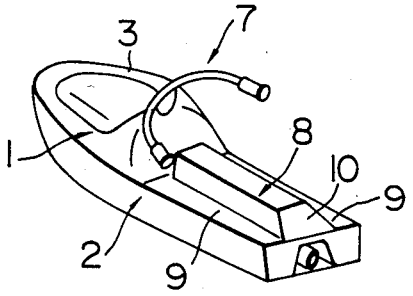
FIG. 1 is a perspective view of an embodiment of a small-sized marine craft in accordance with the invention.
Figure 2:
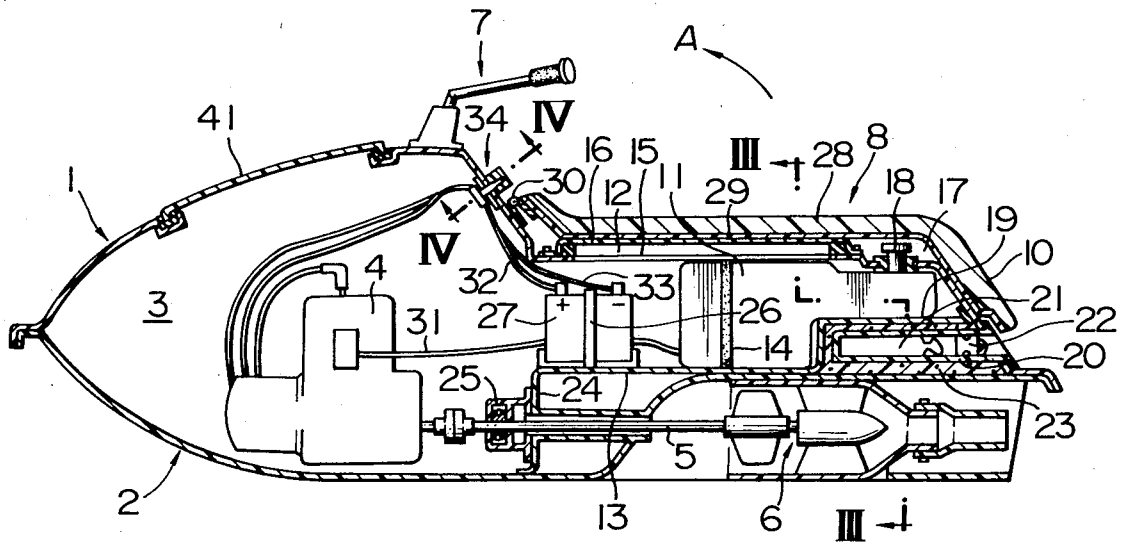
FIG. 2 is a vertical sectional view of the small-sized marine craft shown in FIG. 1.

Referring to FIGS. 1 and 2, a small-sized marine craft of the invention has a hollow shell which is composed of a deck 1 and a hull 2 jointed together. An engine 4 is mounted in an engine room 3 which is formed in a bow portion of the shell. A propeller 6 installed at a rear portion of the hull bottom is adapted to be driven by the engine 4 through a drive shaft 5. An engine hood 41 fits hermetically on an upper opening of the engine room 3 through a sealing member. The engine hood 41 is removable so as to make the engine accessible for the purpose of, for example, maintenance.

The rear portion of the deck behind the engine room constitutes the base of the seat for the rider and for a fellow rider. The rider on the rear deck grips the grip portions of the steering handle bar 7 so as to support himself and to control the marine craft. The rear deck is provided with a raised central longitudinal section projecting above the deck and providing a substantially flat seat 8 and steps 9, 9 on both sides of the seat 8.

In the illustrated embodiment, the rear end of the seat 8 is extended rearwardly and downwardly so as to provide a sloping surface 10.

A fuel tank 11 and a battery 27 are mounted in the space under the seat, in a manner which will be explained hereinunder.

Figure 3:
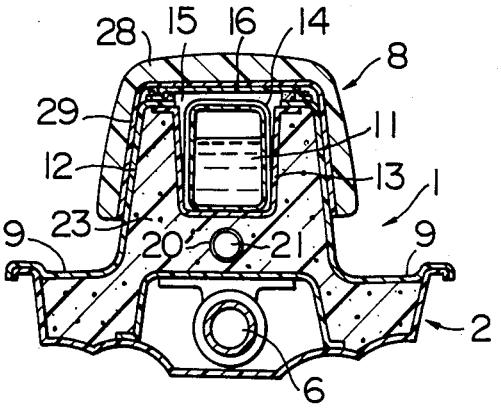
FIG. 3 is a cross-sectional view taken along the line III—III of FIG. 2.

As will be seen from FIG. 3, a box 13 having a substantially U-shaped cross-section is fixed within the central section 12 on the rear deck. The fuel tank 11 is mounted in this box 13 and is fixed by means of rubber bands 14. An opening 15 for allowing the fuel tank 11 to be moved into and out of the box 13 is formed in the upper surface of the central section 12. The opening 15 is usually covered by a detachable cover 16. The rear end portion of the upper surface of the fuel tank 11 is stepped such as to present a flat lowered surface 17. As shown in FIG. 2, a capped tank filling pipe 18 is extended from the fuel tank 11, passes through a hole formed in the lowered surface 17 and projects upwardly. A sealing material is provided between the hole and the pipe 18.

A cylindrical case 20 is disposed in a space formed between a step 19 on the rear of the box 13 and the upper surface of the rear end portion of the hull 2. The cylindrical case 20 accommodates a fire extinguisher 21. The cylindrical case 20 is fixed at its open end portion to the sloping surface 10 at the rear end of the central section 12. A plug 22 with a handle fits in the rearwardly directed open end of the cylindrical case 20 in a water-tight manner. The internal space of the rear part of the shell including the space around the cylindrical case 20 is filled with a buoyant material 23 such as foamed resin.

The box 13 extends forwardly to the rear end of the engine room 3. The forward end of the bottom surface of the box 13 is bent downwardly such as to form a substantially vertical wall 24 on which is mounted a sealed bearing 25 which supports and seals the drive shaft 5 mentioned before.

The battery 27 is disposed within the box 13 at the front side of the fuel tank 11, and is fastened by a fastening band 26.

The central section 12 of the rear deck constituting the base for the seat is covered by the seat which is generally designated at a numeral 8 and constituted by a seat cushion 28 and the seat bottom plate 29. The seat is hinged at its front end as at 30 so as to be able to swing in the direction of the arrow A shown in FIG. 2.

The fuel tank 11 is connected to a carburetor of the engine 4 through a fuel pipe 31 having a fuel pump.

A positive (+) cord 32 leading to the starter solenoid of the engine 4 is connected to the positive terminal of the battery 27, while a negative (−) cord 33 connected to the negative terminal of the battery is grounded to the body of the engine.

Figure 4:
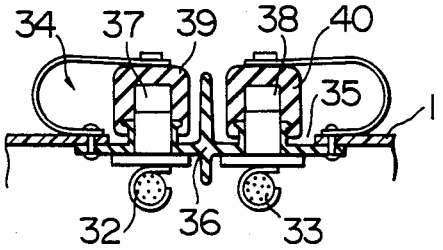
FIG. 4 is an enlarged sectional view taken along the line IV—IV of FIG. 2.

The positive and negative cords 32 and 33 are laid through a battery service 34 provided on the deck 1, as shown in FIGS. 2 and 4.

From FIG. 4, it will be seen that the battery service 34 has an insulating member 36 of, for example, bakelite, positive and negative terminals fixed to the insulating member 36 and electrically connected to the positive and negative cords 32 and 33, and rubber caps 39 and 40 which cover the outer projecting ends of the service terminals 37 and 38. When the battery 27 becomes flat, the engine can be started by another power supply such as a shore connection, or the battery can be charged up by a charger. In such a case, the shore connection or the charger can be connected to the service terminals 37 and 38 after the removal of the rubber caps 39 and 40.

The rubber caps 39 and 40 are connected through suitable strings to the shell 1 or to the insulating member 36 so as not to be easily lost.

An embodiment has been described with reference to FIGS. 1 to 4. This embodiment offers the following advantages.

(i) A projecting seat 8 is formed by a central protrusion on the rear deck. The space in the shell under the protrusion constituting the seat is utilized as the space for accommodating the fuel tank 11 and the battery 27 which in the conventional marine crafts are mounted in the engine room. Therefore, the size of the engine room is reduced, thus allowing a compact design for the shell.

(ii) The fuel tank 11 and the battery 27, which are rather heavy, are mounted on or around the longitudinal axis of the shell, so that the marine craft is well balanced in the port and starboard directions.

(iii) The tendency for the fuel in the fuel tank 11 and the liquid in the battery 27 to wave is suppressed because the fuel tank 11 and the battery 27 are mounted under the rear deck which is less likely to move up and down as compared with the bow portion where the engine room is located. At the same time, since the center of gravity of the marine craft is shifted to the stern portion, the tendency for the bow to be submerged during low speed running of the marine craft is eliminated or suppressed, thus affording a higher running performance.

(iv) When the battery becomes flat, starting of the engine or charging up of the battery can be conducted easily by a shore connection or by using the power of another marine craft or boat, without requiring the opening of the engine hood 41. Further, the possibility of water entrance into the engine room accompanied by an opening step of the engine hood 41 is eliminated.

(v) The fire extinguisher 21 is accommodated by the cylindrical case 20 which opens in the rear end surface of the seat 8. Since the fire extinguisher 21 is isolated from the engine, which is the part most likely to catch fire, and since the fire extingusher 21 can be taken out without difficulty even in the submerged state, a fire-fighting operation is thus considerably facilitated.

(vi) The space in the shell under the seat 8 can be utilized effectively not only for the mounting of the fuel tank 11 and the battery 27 but also for storage of engine key, license and tools, as well as various other articles.

What is claimed is:

1. A small-sized marine craft comprising:

a shell including a deck at its rear part with a raised central longitudinal section projecting above the deck and providing a seat portion extending longitudinally of the craft;

an engine mounted in a bow portion of said shell;

a propulsion means disposed on a stern portion of said shell and drivingly connected to said engine;

a steering handle means provided on a bow portion of said shell;

a fuel tank mounted in a space formed under said seat portion at the rear part of said deck;

a battery disposed in the space under said seat portion;

electric wiring connecting said battery to said engine;

a battery service included at an intermediate portion of said wiring and mounted on a front portion of said deck so as to be accessible from outside said deck; and a detachable waterproof cap for covering said battery service.

* * * * *